US006830153B2

(12) United States Patent
French et al.

(10) Patent No.: US 6,830,153 B2
(45) Date of Patent: Dec. 14, 2004

(54) CHILD-RESISTANT BLISTER PACK

(75) Inventors: Gary Stuart French, Melbourn (GB); Malcolm Ronald Kidd, Swindon (GB)

(73) Assignee: R. P. Scherer Technologies, Inc., Las Vegas, NV (US)

( * ) Notice: Subject to any disclaimer, the term of this patent is extended or adjusted under 35 U.S.C. 154(b) by 0 days.

(21) Appl. No.: 10/141,288

(22) Filed: May 8, 2002

(65) Prior Publication Data

US 2003/0209461 A1 Nov. 13, 2003

(51) Int. Cl.[7] ..... B65D 83/04
(52) U.S. Cl. ..... 206/538; 206/469
(58) Field of Search ..... 206/538, 531, 206/532, 534, 467, 469

(56) References Cited

U.S. PATENT DOCUMENTS

| | | | | | |
|---|---|---|---|---|---|
| 4,305,502 | A | * | 12/1981 | Gregory et al. | 206/532 |
| 4,958,736 | A | * | 9/1990 | Urheim | 206/531 |
| 5,014,851 | A | * | 5/1991 | Wick | 206/539 |
| 5,046,618 | A | * | 9/1991 | Wood | 206/532 |
| 5,325,968 | A | * | 7/1994 | Sowden | 206/532 |
| 5,358,118 | A | * | 10/1994 | Thompson et al. | 206/538 |
| D387,977 | S | * | 12/1997 | Kallgren | D9/348 |
| 5,944,191 | A | * | 8/1999 | Ray et al. | 206/532 |
| 6,155,423 | A | | 12/2000 | Katzner et al. | 206/531 |
| 6,230,894 | B1 | * | 5/2001 | Danville | 206/532 |
| D444,379 | S | * | 7/2001 | Assargren et al. | D9/345 |
| 6,338,407 | B2 | * | 1/2002 | Danville | 206/532 |

* cited by examiner

*Primary Examiner*—Shian T. Luong
(74) *Attorney, Agent, or Firm*—Michael D. Steffensmeier; Carol G. Stovsky

(57) ABSTRACT

The child-resistant blister pack for unit dosage forms has a blister film sheet with depressions therein, unit dosage forms within the depressions and a lidding sheet which overlies the depressions and which is secured to the film sheet so as to seal the unit dosage forms within the depressions. A network of lines of weakness in the pack define a plurality of dosage units. Each dosage unit includes one of said dosage forms and a peel region where part of the lidding sheet is not secured to the blister film sheet. Each peel region is disposed adjacent a respective one of the lines of weakness. The lines of weakness include (a) a first line of weakness extending from a first access point so that, when the first access point is exposed, the blister film sheet and the lidding sheet can be torn along the first line of weakness to expose a second access point and to enable access to the peel region of the first dosage unit; (b) a second line of weakness extending from the second access point so that, when the second access point is exposed, the blister film sheet and the lidding sheet can be torn along the second line of weakness to expose a third access point and enable access to the peel region of the second dosage unit; and (c) a third line of weakness which is spaced from the first line of weakness and which extends from the third access point so that, when the third access point is exposed, the blister film sheet and the lidding sheet can be torn along the third line of weakness to enable access to the peel region of a third dosage unit.

21 Claims, 4 Drawing Sheets

CHILD-RESISTANT BLISTER PACK

FIELD OF THE INVENTION

This invention relates to a child-resistant blister pack for unit dosage forms. More particularly, but not exclusively, the blister pack is intended for containing and protecting solid unit dosage forms of the fast-dissolving type. These are particularly fragile and require to be packed in strong packaging to prevent them from being crushed during handling; but nevertheless the pack must be capable of being opened by an adult without damage to the dosage forms.

BACKGROUND OF THE INVENTION

Many countries have introduced legislation in which standard tests are required to be complied with to render drug packs sufficiently difficult for children to open while still being openable relatively easily by an adult.

One form of known child-resistant blister pack is disclosed in U.S. Pat. No. 5,046,618 wherein the pack includes a blister film sheet having depressions therein in each of which there is a solid fast-dispersing dosage form. The blister film sheet is covered with a lidding sheet which overlies the depressions and which is secured to the blister film sheet so as to seal the unit dosage forms within the depressions. The material forming the blister pack is sufficiently strong such that even an adult has great difficulty in tearing it without weakening lines being provided in the pack.

In the blister pack of U.S. Pat. No. 5,046,618, the depressions are arranged in two parallel rows on either side of a central weakening line which extends longitudinally of the pack from an access region to a location which stops short of the opposite end of the pack. The weakening line is defined by a series of spaced perforations through the blister film sheet and the lidding sheet. A series of transverse weakening lines of a similar type are also provided in the blister pack between adjacent depressions in each row. The resultant network of weakening lines defines a plurality of individual dosage units, each of which includes one of the depressions containing a solid unit dosage form. Each dosage unit includes a peel region where part of the lidding sheet is not secured to the blister film. This peel region is disposed adjacent a respective one of the lines of weakness in the network so that it is exposed only when the blister pack has been torn along this line. Once the blister pack has been torn along this line, the peel region is exposed for manual grasping so as to enable the portion of the lidding sheet on the dosage unit to be peeled back to enable access to be gained to the unit dosage form within the depression. To enable access to be gained to the longitudinal weakening line, the line may extend to the adjacent end of the blister pack so as to provide an immediate access point. Alternatively, a further transverse line having its own access point may be provided in the blister pack. In the latter arrangement, the longitudinal weakening line extends to this further transverse line so that, when the pack is torn along the further transverse line, the access point for tearing the longitudinal weakening line is exposed.

U.S. Pat. No. 6,155,423 also discloses a blister pack which has child-resistant features and where a longitudinal weakening tear line and transverse weakening tear lines are provided in the blister pack so as to define individual dosage units containing the unit dosage forms. In this case, the ends of all the weakening tear lines terminate in regions at the edges of the blister pack which are more difficult to tear than weakening tear lines themselves and which are provided in the vicinity of indentations or notches extending inwardly towards the outer ends of the weakening tear lines to serve as intuitive indicators of a separation area for the user of the package.

While the blister packs described in the above mentioned publications are indeed child-resistant to a greater or lesser extent, there is a continuing requirement to make blister packs even more child resistant while still enabling relatively simple access by adults.

The present invention has for its object to provide an improved child-resistant blister pack.

SUMMARY OF THE INVENTION

According to the present invention, there is provided a child-resistant blister pack for unit dosage forms, said pack comprising:

(i) a blister film sheet with depressions therein;

(ii) unit dosage forms within the depressions;

(iii) a lidding sheet which overlies the depressions and which is secured to the film sheet so as to seal the unit dosage forms within the depressions; and (iv) a network of lines of weakness in the pack defining a plurality of dosage units, each dosage unit including (a) one of said dosage forms sealed in one of the depressions and (b) a peel region where part of the lidding sheet is not secured to the blister film sheet, each peel region being disposed adjacent a respective one of the lines of weakness in the network;

wherein said lines of weakness include:

(1) a first line of weakness extending from a first access point so that, when the first access point is exposed, the blister film sheet and the lidding sheet can be torn along the first line of weakness to expose a second access point and also enable access to the peel region of the first dosage unit;

(2) a second line of weakness extending from the second access point so that, when the second access point is exposed, the blister film sheet and the lidding sheet can be torn along the second line of weakness to expose a third access point and also enable access to the peel region of the second dosage unit; and (3) a third line of weakness which is spaced from the first line of weakness and which extends from the third access point so that, when the third access point is exposed, the blister film sheet and the lidding sheet can be torn along the third line of weakness to enable access to the peel region of a third dosage unit.

It will be appreciated that, in the blister pack of the present invention, tearing the pack along each weakening line only exposes one of the peel regions and the next access point for tearing along the next weakening line. This makes it much more difficult for the individual dosage units to be separated from the pack to the extent that their peel regions can be accessed. This is in contrast to the blister packs of U.S. Pat. Nos. 5,046,618 and 6,155,423 where, once access has been gained to the longitudinal weakening line, the whole of the pack can be torn into two separate parts making it easier to gain access to the individual dosage units in these separated parts. Additionally, in the present invention, since the user is forced to separate the individual dosage units from the remainder of the pack in a particular order, he or she will not be tempted initially tear the pack into two parts each containing a plurality of dosage units. Thus, the remaining dosage units in the blister pack are all kept together for safe and easy storage.

Preferably, the lines of weakness further include at least one additional line of weakness along which the blister film sheet and the lidding sheet are required to be torn in order to gain access to said first line of weakness. Where there is more than one such additional line of weakness, the arrangement is preferably such that these have to be torn in sequence in order to access said first line of weakness.

The pack may also include at least one further line of weakness with no access points and/or at least one visual feature giving the appearance of a line of weakness so as to act as a further child-resistant feature. An attempt to open the pack using these features would be unsuccessful and assist in causing the child to lose interest in opening the package.

In a preferred embodiment, said first line of weakness extends along two sides of said first dosage unit and along one side of said second dosage unit and terminates in a region which is aligned with and joined to said second line of weakness at said second access point. With such an arrangement, when said first dosage unit has been removed from the pack, the second access point is exposed, thus permitting the pack to be torn again along said second line of weakness to detach said second dosage unit from the pack. The first and second lines of weakness preferably terminate a short distance away from opposite sides of the pack. In this way, while it is impossible to gain entry to the respective lines of weakness by attempting to tear into the opposite sides of the pack, it is possible to tear the dosage units completely from the pack once they have been torn along their respective lines of weakness because the tear in the material has already been started.

In a preferred embodiment, the first line of weakness includes inclined portions which are preferably mutually perpendicular and which may be linear. The first line of weakness may comprise the mutually inclined portions with an intermediate connecting portion between them. This promotes tearing of the pack along the desired line rather than continuing along a straight line. It also obviates the risk of unwanted continued tearing along said third line of weakness even when the latter is in alignment with the first line of weakness.

The intermediate connecting portion may be inclined with respect to both of the inclined portions and may be linear.

In most cases, the blister pack includes more than three blisters and dosage forms. In which case, further lines of weakness similar to said first, second and third lines of weakness may be provided as required to provide a network of lines arranged so that the further dosage units have to be removed in a predetermined order.

It is within the scope of the present invention to provide a pack where further lines of weakness define at least one unit without a unit dosage form therein. Such a unit may be provided at a location where it must be torn away before access can be gained to any of the dosage forms.

For the avoidance of doubt, it is hereby stated that references to "first", "second" and "third" in relation to the dosage units are included solely for assisting in distinguishing between individual dosage units in the pack and are not to be taken as indicating that these are the first, second and third dosage units to be accessed when the pack is opened. The same applies to the use of "first", "second" and "third" in relation to the weakening lines and the access points. This will become apparent from the description hereinafter in relation to the embodiment of FIG. 5.

BRIEF DESCRIPTION OF THE DRAWINGS

Embodiments of the present invention will now be described, by way of example, with reference to the accompanying drawings in which.

DETAILED DESCRIPTION OF PREFERRED EMBODIMENTS

Figure 1:
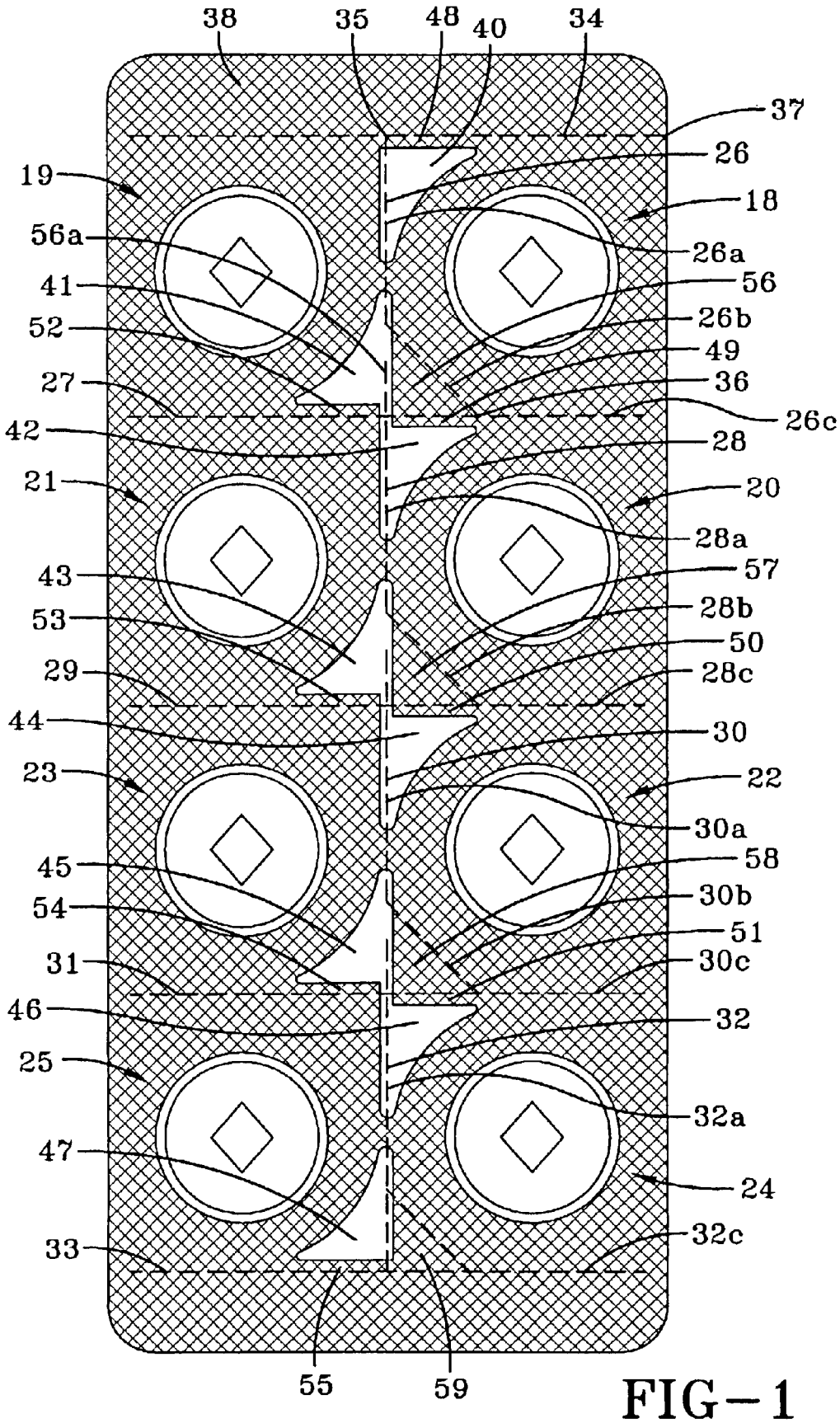
FIG. 1 is a plan view of one embodiment of a child-resistant blister pack in accordance with the present invention.
Figure 2:
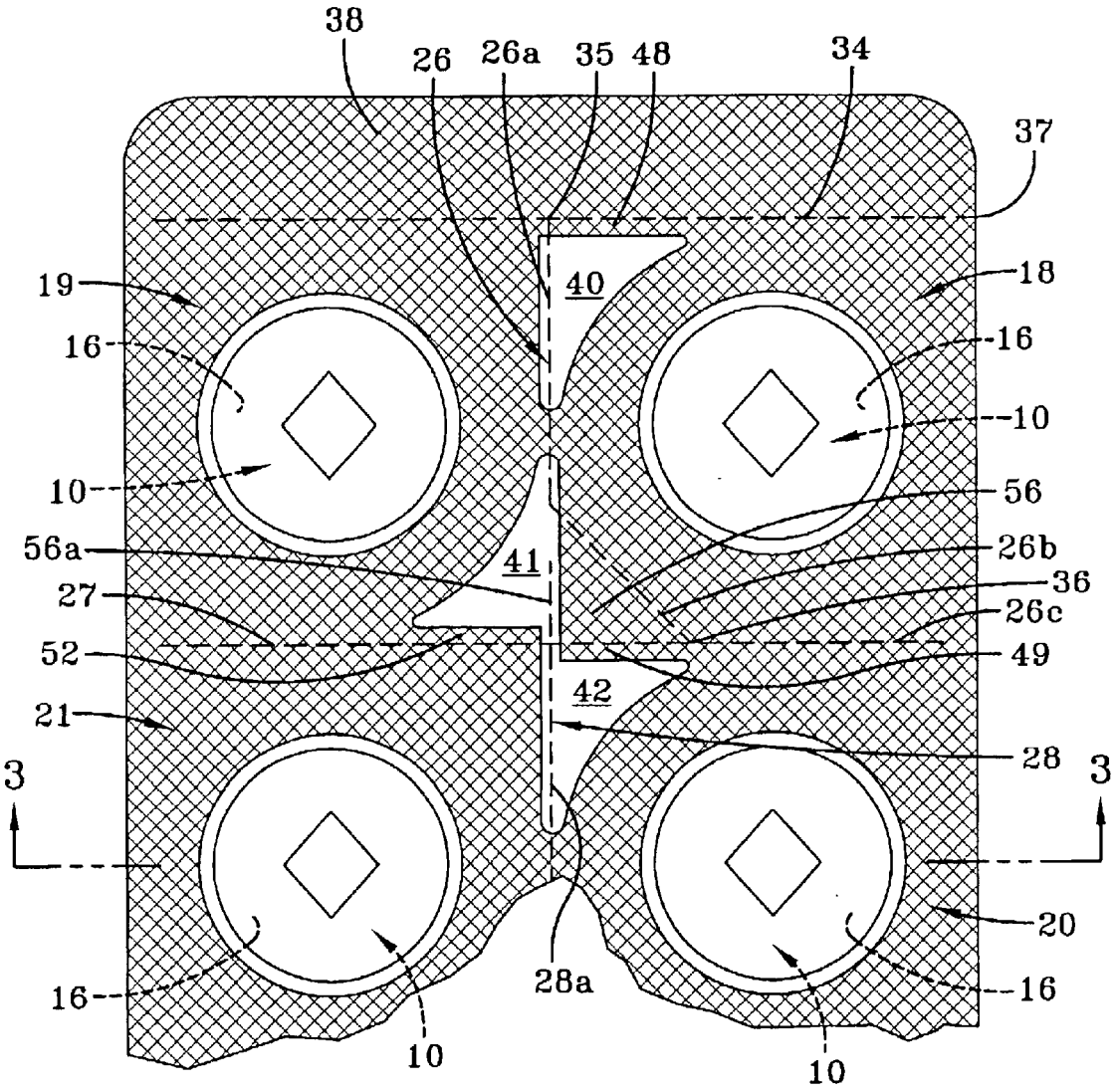
FIG. 2 is a plan view on a larger scale of part of the pack of FIG. 1.
Figure 3:
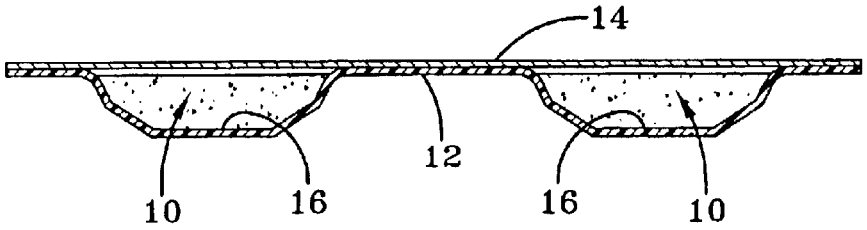
FIG. 3 is a cross section on a larger scale through the pack of FIG. 1, and FIGS. 4A–4F are plan views of portions of the pack of FIG. 1 showing the sequence of accessing dosage forms in the pack.
Figure 4A:
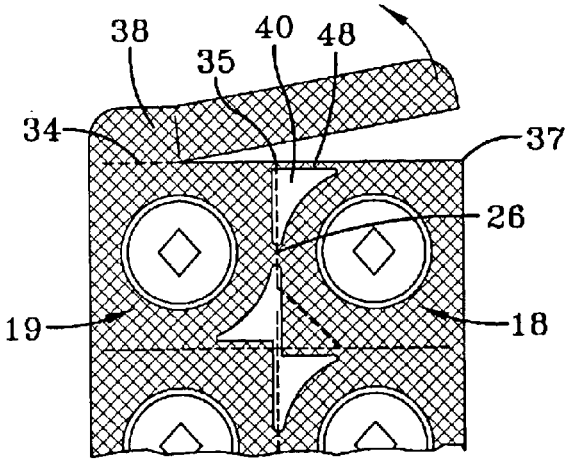
Figure 4B:
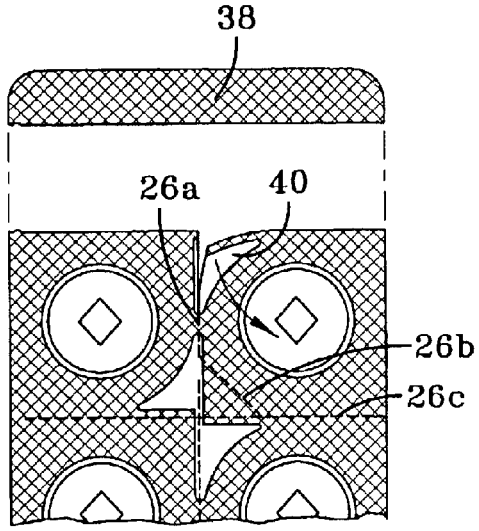
Figure 4C:
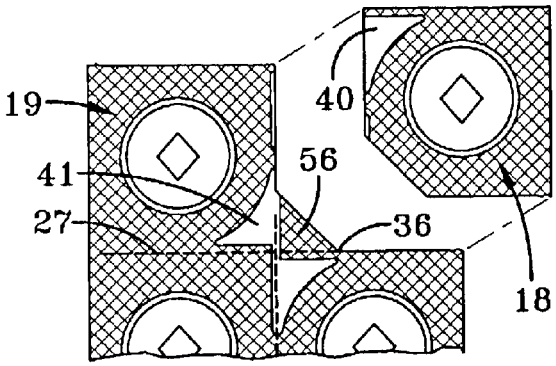
Figure 4D:
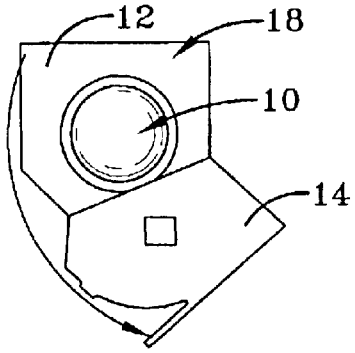
Figure 4E:
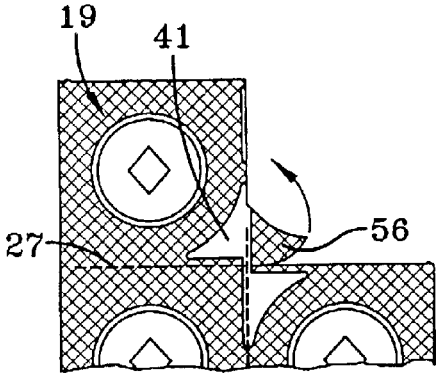
Figure 4F:
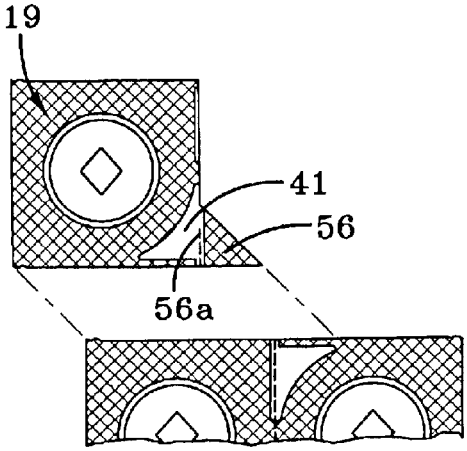

Referring now to the embodiment of FIGS. 1–4, the child-resistant blister pack illustrated therein is for solid, fast-dispersing pharmaceutical dosage forms 10 (FIG. 3). The blister pack (see FIG. 3) comprises a blister film sheet 12 and an overlying lidding sheet 14, both of which are designed to have such a high tear resistance that they are virtually impossible to tear even by an adult except along lines of weakness which will be described in detail hereinafter. The blister film sheet 12 may be formed of a translucent or opaque films, laminated films or co-extruded films of polymers such as, for example, polyvinyl chloride, polyvinyl dichloride, or polyethylene, or metals such as, for example, aluminum, or any combination thereof. The lidding sheet 14 is a multilayer sheet comprised of a laminate of polyester, aluminum and paper in order to impart the desired strength and moisture impermeability characteristics. Suitable materials for forming the film sheet 12 and lidding sheet 14 are known in the art and will not be described in any further detail herein.

The blister film sheet 12 in this embodiment is formed with eight depressions 16 therein arranged in two rows of four. Each depression 16 holds a respective one of the solid fast-dispersing dosage forms 10. In this embodiment, the dosage forms 10 have been formed within the depression 16 by introducing controlled amounts of an aqueous suspension of the dosage form into each depression and then lyophilizing the dispersion in a manner known per se to produce a solid matrix defining the dosage form 10 within each depression 16. The lidding sheet 14 is then heat sealed into position over the depressions so as to seal the dosage forms 10 in the depression 16. The techniques of filling the depressions with an aqueous dispersion, lyophilizing the dispersion and then covering the filled depressions with the lidding sheet are per se known in the art. The depressions 16 could also be filled with capsules, pills, tablets and other suitable items.

The blister pack further includes a network of lines of weakness defined by spaced perforations through blister film sheet 12 and the lidding sheet 14 so that these sheets can be manually torn along such lines. However, the sheets 12 and 14 are sufficiently tear-resistant to be virtually impossible to tear open manually other than along the lines of weakness.

The network of lines of weakness in the blister pack is arranged so as to define first to eighth dosage units 18 to 25, respectively. The lines of weakness comprise first to ninth lines of weakness 26 to 34, respectively. The first line of weakness 26 comprises a first linear portion 26*a* which extends from a first access point 35 in a direction longitudinally of the blister pack, a second linear portion 26*b* which is inclined or angled with respect to the first portion 26*a*, and a third linear portion 26*c* which extends from the second portion 26*b* perpendicularly with respect to the first portion 26*a* and terminates at a location which is spaced a short distance inwardly of one of the longitudinal edges of the pack. The second portion 26*b*, in this embodiment, subtends an angle of about 135° with respect to each of the first and third portions 26*a* and 26*c*. Other suitable angles will also be effective.

At the junction between the second portion 26*b* and the third portion 26*c* there is defined a second access point 36 from which the second line of weakness 27 extends in alignment with the third portion 26*c*. The second line of weakness 27 extends across the blister pack to terminate a short distance inwardly of the opposite longitudinal edge of the pack.

The third, fifth and seventh lines of weakness 28 and 32, respectively, are of the same shape as the first line of weakness 26, while the fourth, sixth and eighth lines of weakness 29, 31 and 33 are similar to the second line of weakness 27. As can be seen from FIGS. 1 and 2, the first, third, fifth and seventh lines of weakness 26, 28, 30 and 32 have their first portions 26*a*, 28*a*, 30*a* and 32*a* in mutual alignment on the central longitudinal axis of the blister pack. However, these first portions 26*a*, 28*a*, 30*a* and 32*a* are spaced apart from each other longitudinally of the blister pack. This results in the blister pack not being subject to being torn in half down the middle to access depressions 16 out of sequence, which helps make the pack more child-resistent.

The ninth line of weakness 34 extends from an initial access point 37 transversely of the blister pack a short distance from the end thereof to terminate a short distance inwardly of the opposite longitudinal edge of the strip so as to define a tear-off tab 38. The first access point 35 lies on the ninth line of weakness 34.

At the opposite end of the blister pack to the tab 38, the eighth line of weakness 33 and the third portion 32*c* of the seventh line of weakness 32 extend in alignment transversely of the blister pack in a similar manner to the ninth line of weakness 34 except that they stop short of the longitudinal edges of the blister pack. Thus, there is no access to the pack at this opposite end of the pack, although there appears to be one from a cursory examination.

The lidding sheet 14 is secured to the blister film sheet 12 over the whole of the area of the blister pack except (i) where they overlie the depressions 16 and (ii) in localized first to eighth peel regions 40 to 47. The areas where the lidding sheet 14 is secured to the blister film sheet 12 are shown cross-hatched in FIGS. 1 and 2, whereas the unsecured areas are shown without any cross-hatching. The first to eighth peel regions 40 to 47 are associated with the respective first to eighth dosage units 18 to 25. These peel regions 40 to 47 are essentially triangular and are provided at one of the four corners of each dosage unit 18 to 25. As can be seen from FIGS. 1 and 2, each peel region 40 to 47 is disposed inwardly of the blister pack adjacent the longitudinal center line of the pack so that it cannot be accessed until the pack has been torn along the adjacent lines of weakness 26 to 33, respectively.

The first peel region 40 is disposed adjacent the first line of weakness 26 near to the first access point 35. However, for security reasons, the first peel region 40 is spaced a short distance inwardly of the ninth line of weakness 34, being separated therefrom by a narrow region 48 of the lidded sheet which is secured to the underlying blister film sheet 12.

The third, fifth and seventh peel regions 42, 44 and 46 associated with the third, fifth and seventh dosage units 20, 22 and 24 are disposed in a similar way to the first peel region 40 so that they are adjacent the respective third, fifth and seventh lines of weakness 28, 30 and 32, and are separated by respective narrow sealed regions 49, 50 and 51 from the respective second, fourth and sixth lines of weakness 27, 29 and 31. The second, fourth, sixth and eighth peel regions 41, 43, 45 and 47 are likewise separated from the second, fourth, sixth and eighth lines of weakness 27, 29, 31 and 33, respectively, by respective narrow sealed regions 52, 53, 54 and 55. However, access to these can be gained at the appropriate stage using tear-off triangular tab regions 56 to 59, respectively, as will be apparent later herein.

The above-described network of lines of weakness is designed to ensure that the dosage units 18 to 25 can only be removed in a predetermined sequence to access the unit dosage forms therein. This is achieved as follows (see FIGS. 4A–4F):

An adult desiring to open the blister pack in order to extract one of the solid dosage forms has to recognize that there is only a single initial access point 37 at which tearing of the pack can be initiated. This can be recognized by closely inspecting the blister pack to see where there is a line of weakness which extends to one of the edges of the pack. In the present embodiment, this is only where the ninth line of weakness 34 reaches the longitudinal edge of the blister pack at the initial access point 37. However, this procedure and the remaining opening procedures may be facilitated for adults by accompanying instructions and/or a diagram showing the sequential opening operations required to gain access to the dosage units in turn.

Once the initial access point 37 has been identified, the tear off tab 38 can be grasped and used to tear the pack along the ninth line of weakness 34. In so doing, the tear off tab 38 can be relatively easily completely removed from the pack because, once tearing has been initiated along the ninth line of weakness 34, it is relatively easy to continue to tear the tab 38 right through the remaining unweakened portion at the opposite longitudinal side edge of the blister pack. Tearing along the ninth line of weakness 34 does not serve to expose the first peel portion 40 because of the existence of the region 48. However, it exposes the first access point 35 so that the adult can then start to tear the pack along the first line of weakness 26. Tearing along this line takes place sequentially along the first portion 26*a*, the second portion 26*b*, and then the third portion 26*c*, thus enabling the first dosage unit 18 to be completely removed from the blister pack.

Once this has been achieved, it is then possible to gain access to the first peel region 40 because the unsecured region of the lidded sheet 14 is now exposed at the edge of the dosage unit 18 separated upon tearing of the first portion 26*a*. Manual grasping of the peel region 40 enables the lidded sheet 14 on the first dosage unit 18 to be peeled back to reveal the solid dosage form 10 within the depression 16 in the dosage unit 18 (see FIG. 4D). At this stage, it will be appreciated that the remaining second to eighth dosage units 19 to 25 are still remaining in the as-yet unopened part of the pack.

Removal of the first dosage unit 18 now exposes the second access point 36 at one end of the second line of weakness 27. Thus, when the adult needs to take a second dose, it is necessary to make a tear along the second line of weakness 27. This is achieved starting at the now exposed second access point 36 to detach the second dosage unit 19 completely from the pack. Tearing of the pack along the second line of weakness 27 enables access to be gained to the second peel region 41 on the second dosage unit 19 via the tear-off tab region 56 whose tear line 56*a* is now accessible. After this, the second peel region can be manually grasped and used to peel away the lidded sheet to reveal the unit dosage form in the second dosage unit 19. It is to be noted that the tear line 56*a* terminates at a location which is spaced longitudinally from the portion 26*a* of the first line of weakness 26 so as to prevent the tear from continuing along the tear line 56*a* when the portion 26*a* is torn.

It will be appreciated from the above that, as further doses are needed, the adult is forced to remove the third to eighth dosage units in turn in a similar way to that described above for the first and second dosage units 18 and 19.

Thus, the blister pack described above requires a certain set sequence of tearing operations to be employed before even access to any of the peel regions is possible. Because those portions 26*a*, 28*a*, 30*a* and 32*a* of the lines of weakness 26, 28, 30 and 32 which extend longitudinally of the pack are separated from one another and because the intermediate portions 26*b*, 28*b* and 30*b* are directed away from the longitudinal center line, it is virtually impossible to tear the pack completely along its longitudinal center line. Thus, it is not possible to divide the pack longitudinally in two halves which would then facilitate more or less equal access to all of the other dosage units.

It will be appreciated that, because of the intermediate inclined portion 26*b* of the first line of weakness 26, when tearing takes place along this line, the tear-off tab region 56 remains and its tear line 56*a* is inaccessible at this stage. The lidding sheet 14 over the area of this tab region 56 is secured to the blister film sheet 12 so preventing ready access to the second peel region 41 of the second dosage unit 19 at the stage when the first dosage unit 18 is removed from the pack. The corresponding tear-off triangular tab regions 57, 58 and 59 associated with the third, fifth and seventh dosage units 20 and 22 are similarly constructed so as to deny access to the peel regions 43, 45 and 47 before the fourth, sixth and eighth dosage units have been detached from the blister pack.

Figure 5:
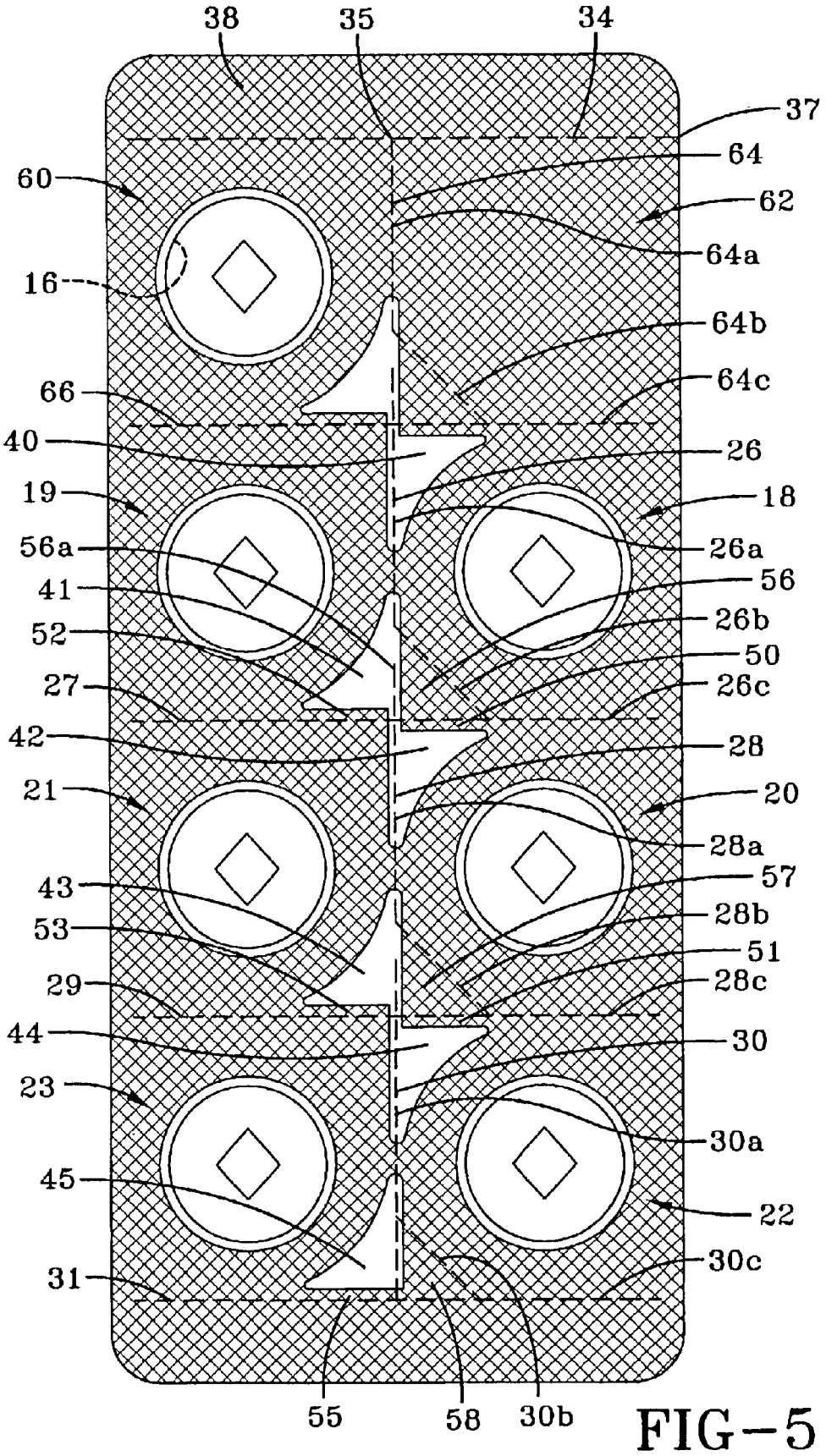
FIG. 5 is a plan view of a second embodiment of a child-resistant blister pack according to the present invention.

Reference is now drawn to the embodiment of FIG. 5 in which similar parts to those of the embodiment of FIGS. 1–4 are accorded the same reference numerals. In FIG. 5, the dosage units 18, 19 and 20 corresponding to the first, second and third dosage units of FIG. 1 (and as defined in the claims) are not the first, second and third dosage units which are accessed when the pack is opened. The pack of FIG. 5 contains only seven dosage units made up of first to sixth dosage units 18 to 23 which correspond in design to the first to sixth dosage units 18 to 23 of the pack of FIGS. 1–4, a further dosage unit 60 and a blank unit 62 containing no dosage units. The blank unit 62 and the further dosage unit 60 have associated tear lines 64 (with portions 64*a*, 64*b* and 64*c*) and 66 which are similar to the above-described first and second tear lines 26 and 27. When opening the pack, the unit initially accessed is the blank unit 62, while the next to be accessed is the further dosage unit 60. This provides additional resistance against a child accessing even one of the dosage forms within the pack. It also may be useful where a seven day, single dose medication regime is prescribed.

It is necessary to ensure that the lidding sheet 14 is sufficiently strongly attached to the blister film sheet 12 that it adequately seals around the depressions 16 and provides adequate resistance to peel, but yet is readily peelable by an adult wishing to gain access to the solid dosage forms 10. This can be achieved by appropriate control of the temperature, time and pressure employed when sealing the lidding sheet 14 to the blister film sheet 12 and by appropriately designing the length of the seal line which is exposed as the lidding sheet 14 is peeled back using the peel regions.

It is to be appreciated that various modifications may be made within the scope of the present invention. For example, if desired, the narrow sealed regions may be omitted so as to permit the respective peel regions 41, 43, 45 and 47 to be directly accessed when the pack has been torn along the respective lines of weakness 27, 29, 31 and 33. In which case, there may be no need for the tab regions 56, 57, 58 and 59 to be designed to be torn away. Thus, the associated tear lines, such as tear line 56*a*, can be omitted.

What is claimed is:

1. A child-resistant blister pack that enables separating a plurality of dosage units in a particular order, said pack comprising:

(i) a blister film sheet with depressions therein;

(ii) dosage forms within the depressions;

(iii) a lidding sheet which overlies the depressions and which is secured to the film sheet so as to seal the dosage forms within the depressions; and (iv) a network of lines of weakness in the pack defining the plurality of dosage units, each dosage unit including (a) one of said dosage forms sealed in one of the depressions covered by the lidding sheet and (b) a peel region where part of the lidding sheet is not secured to the blister film sheet, each peel region being disposed adjacent a respective one of the lines of weakness in the network;

wherein said lines of weakness include:

(1) a first line of weakness extending from a first access point so that, when the first access point is exposed, the blister film sheet and the lidding sheet can be torn along the first line of weakness to expose a second access point wherein the second access point enables access to only a second line of weakness and also to enable access to the peel region of a first dosage unit;

(2) wherein the second line of weakness extending from the second access point so that, when the second access point is exposed, the blister film sheet and the lidding sheet can be torn along the second line of weakness to expose a third access point wherein the third access point enables access to only a third line of weakness and also to enable access to the peel region of a second dosage unit; and (3) wherein the third line of weakness which is spaced from the first line of weakness and which extends from the third access point so that, when the third access point is exposed, the blister film sheet and the lidding sheet can be torn along the third line of weakness to enable access to the peel region of a third dosage unit.

2. The child-resistant blister pack of claim 1, wherein the lines of weakness further include at least one additional line of weakness along which the blister film sheet and the lidding sheet are required to be torn in order to expose said first access point.

3. The child-resistant blister pack of claim 2, wherein said first line of weakness extends along two sides of said first dosage unit and along one side of said second dosage unit and terminates in a region which is aligned with and joined to said second line of weakness at said second access point.

4. The child-resistant blister pack of claim 2, wherein the first line of weakness includes inclined portions.

5. The child-resistant blister pack of claim 1, further including at least one further apparent line of weakness with no access points.

6. The child-resistant blister pack of claim 1, wherein said first line of weakness extends along two sides of said first dosage unit and along one side of said second dosage unit and terminates in a region which is aligned with and joined to said second line of weakness at said second access point.

7. The child-resistant blister pack of claim 1, wherein the first line of weakness includes inclined portions.

8. The child-resistant blister pack of claim 7, wherein two of the inclined portions are perpendicular.

9. The child-resistant blister pack of claim 8, wherein the first line of weakness comprises the inclined portions with an intermediate connecting portion between them.

10. The child-resistant blister pack of claim 9, wherein the intermediate connecting portion is angled with respect to both of the inclined portions.

11. The child-resistant blister pack of claim 7, wherein the inclined portions themselves are substantially linear.

12. The child-resistant blister pack of claim 7, wherein the first line of weakness comprises the inclined portions with an intermediate connecting portion between them.

13. The child-resistant blister pack of claim 12, wherein the intermediate connecting portion is angled with respect to both of the inclined portions.

14. The child-resistant blister pack of claim 12, wherein the intermediate connecting portion is linear.

15. A child-resistant blister pack for unit dosage forms, said pack comprising:

(i) a blister film sheet with depressions therein;

(ii) dosage forms within the depressions;

(iii) a lidding sheet which overlies the depressions and which is secured to the film sheet so as to seal the dosage forms within the depressions; and (iv) a network of lines of weakness in the pack defining a plurality of dosage units, each dosage unit including (a) one of said dosage forms sealed in one of the depressions and (b) a peel region where part of the lidding sheet is not secured to the blister film sheet, each peel region being disposed adjacent a respective one of the lines of weakness in the network;

wherein said lines of weakness include:

(1) a first line of weakness comprising inclined portions with an intermediate connecting portion and extending from a first access point so that, when the first access point is exposed, the blister film sheet and the lidding sheet can be torn along the first line of weakness to expose a second access point and also to enable access to the peel region of the first dosage;

(2) a second line of weakness extending from the second access point so that, when the second access point is exposed, the blister film sheet and the lidding sheet can be torn along the second line of weakness to expose a third access point and also to enable access to the peel region of the second dosage unit; and (3) a third line of weakness which is spaced from the first line of weakness and which extends from the third access point so that, when the third access point is exposed, the blister film sheet and the lidding sheet can be torn along the third line of weakness to enable access to the peel region of the third dosage unit; and (4) wherein a tab region is defined between the intermediate connecting portion, the second line of weakness and the peel region of the second dosage unit and remains joined to the peel region of the second dosage unit after the pack has been torn along the first and second lines of weakness.

16. The child-resistant blister pack of claim 15, wherein the tab region is a tear-away tab region, and said peel region of the second dosage unit is separated from said second line of weakness by a region of the lidding sheet that is secured to the blister film sheet so that access is gained to said peel region by tearing away the tab region.

17. A child-resistant blister pack for unit dosage forms, said pack comprising:

(i) a blister film sheet with depressions therein;

(ii) dosage forms within the depressions;

(iii) a lidding sheet which overlies the depressions and which is secured to the film sheet so as to seal the dosage forms within the depressions; and (iv) a network of lines of weakness in the pack defining a plurality of dosage units, each dosage unit including (a) one of said dosage forms sealed in one of the depressions and (b) a peel region where part of the lidding sheet is not secured to the blister film sheet, each peel region being disposed adjacent a respective one of the lines of weakness in the network;

wherein said lines of weakness include:

(1) a first line of weakness comprising inclined portions with an intermediate connecting portion angled with respect to the inclined portions and extending from a first access point so that, when the first access point is exposed, the blister film sheet and the lidding sheet can be torn along the first line of weakness to expose a second access point and also to enable access to the peel region of the first dosage unit;

(2) a second line of weakness extending from the second access point so that, when the second access point is exposed, the blister film sheet and the lidding sheet can be torn along the second line of weakness to expose a third access point and also to enable access to the peel region of the second dosage unit; and (3) a third line of weakness which is spaced from the first line of weakness and which extends from the third access point so that, when the third access point is exposed, the blister film sheet and the lidding sheet can be torn along the third line of weakness to enable access to the peel region of the third dosage unit, and;

(4) wherein a tab region is defined between the intermediate portion, the second line of weakness and the peel region of the second dosage unit and remains joined to the peel region of the second dosage unit after the pack has been tom along the first and second lines of weakness.

18. The child-resistant blister pack of claim 17, wherein the tab region is a tear-away tab region, and said peel region of the second dosage unit is separated from said second line of weakness by a region of the lidding sheet that is secured to the blister film sheet so that access is gained to said peel region by tearing away the tab region.

19. A child-resistant blister pack that enables separating a plurality of dosage units in a particular order, said pack comprising:

(i) a blister film sheet with depressions for containing dosage forms;

(ii) a lidding sheet which overlies the depressions and which is secured to the film sheet so as to seal the depressions; and (iii) a network of lines of weakness in the pack defining the plurality of dosage units, each dosage unit Including (a) one of the dosage forms sealed in one of the depressions covered by the lidding sheet and (b) a peel region where part of the lidding sheet is not secured to the blister film sheet, each peel region being disposed adjacent a respective one of the lines of weakness in the network;

wherein said lines of weakness include:

(1) a first line of weakness extending from a first access point so that, when the first access point is exposed, the blister film sheet and the lidding sheet can be torn along the first line of weakness to expose a second access point wherein the second access point enables access to only a second line of weakness and also to enable access to the peel region of a first dosage unit;

(2) wherein the second line of weakness extending from the second access point so that, when the second access point is exposed, the blister film sheet and the lidding sheet can be torn along the second line of weakness to expose a third access point wherein the third access point enables access to only a third line of weakness and also to enable access to the peel region of a second dosage unit; and (3) wherein the third line of weakness which is spaced from the first line of weakness and which extends from the third access point so that, when the third access point is exposed, the blister film sheet and the lidding sheet can be torn along the third line of weakness to enable access to the peel region of a third dosage unit.

20. The child-resistant blister pack of claim 19, wherein at least one line of weakness defines at least one unit without a dosage form therein.

21. The child-resistant blister pack of claim 20, wherein said at least one unit without a dosage form therein is provided at a location where it must be torn away before access can be gained to any of the dosage units.

* * * * *